US007388552B2

(12) United States Patent
Mori

(10) Patent No.: US 7,388,552 B2
(45) Date of Patent: Jun. 17, 2008

(54) MULTIBEAM ANTENNA

(75) Inventor: Kohei Mori, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 11/201,424

(22) Filed: Aug. 11, 2005

(65) Prior Publication Data

US 2006/0044200 A1 Mar. 2, 2006

(30) Foreign Application Priority Data

Aug. 24, 2004 (JP) ..... 2001-244047

(51) Int. Cl.
*H01Q 13/10* (2006.01)

(52) U.S. Cl. ..... 343/770; 343/767; 343/768

(58) Field of Classification Search ..... 343/833, 343/834, 770, 769, 817, 818, 767, 768
See application file for complete search history.

(56) References Cited

U.S. PATENT DOCUMENTS

| | | | | |
|---|---|---|---|---|
| 3,577,196 | A * | 5/1971 | Pereda | 343/770 |
| 5,917,454 | A * | 6/1999 | Hill et al. | 343/769 |
| 6,049,310 | A * | 4/2000 | Sadahiro | 343/702 |
| 6,147,651 | A * | 11/2000 | Yamazaki et al. | 343/702 |
| 6,407,719 | B1 * | 6/2002 | Ohira et al. | 343/893 |
| 6,781,556 | B2 * | 8/2004 | Kojima et al. | 343/818 |
| 6,788,266 | B2 * | 9/2004 | St. Hillaire et al. | 343/770 |
| 6,888,505 | B2 * | 5/2005 | Tran | 343/702 |
| 2003/0156061 | A1 * | 8/2003 | Ohira | 342/372 |
| 2003/0193446 | A1 * | 10/2003 | Chen | 343/893 |
| 2005/0088358 | A1 * | 4/2005 | Larry et al. | 343/833 |
| 2006/0232492 | A1 * | 10/2006 | Sawatani | 343/893 |

FOREIGN PATENT DOCUMENTS

| | | |
|---|---|---|
| JP | 50-117343 | 9/1975 |
| JP | 52-4896 | 2/1977 |
| JP | 09-232864 | 9/1997 |
| JP | 10-123142 | 5/1998 |
| JP | 2001-244720 | 9/2001 |
| JP | 2002-330024 | 11/2002 |
| JP | 2003-142919 | 5/2003 |
| JP | 2005-210520 | 8/2005 |
| JP | 2005-210521 | 8/2005 |
| JP | 2005-253043 | 9/2005 |
| JP | 2005-322972 | 11/2005 |
| JP | 2006-013893 | 1/2006 |
| WO | WO 03/058758 | 7/2003 |

OTHER PUBLICATIONS

Japanese Office Action: Application No. 2004-244047: Dated: Mar. 6, 2007.

* cited by examiner

*Primary Examiner*—Hoang V. Nguyen
(74) *Attorney, Agent, or Firm*—Rader, Fishman & Grauer PLLC; Ronald P. Kananen

(57) ABSTRACT

The present invention has been made to reduce the size and thickness of a multibeam antenna capable of switching the directivity in multi directions. The present invention provides a multibeam antenna including an antenna element array including one or more feed element and N (N: natural number) parasitic elements, wherein the electrical length of one or more parasitic elements are made variable.

9 Claims, 21 Drawing Sheets

Slot width 2mm
FR-4 board (40mm square, 1mm thickness)

Slot width 2mm
FR-4 board (40mm square, 1mm thickness)

Slot width 2mm
FR-4 board (40mm square, 1mm thickness)

(a):Short PIN is provided for parasitic slot #1
(b):Short PIN is provided for parasitic slot #2
WS=WP=2,LS17,SP=15,LP1=18.5,LP2=2.0,LG=40 (Unit:[mm])

(a):#1=0.5pF #2=18pF
(b):#1=18pF #2=0.5pF (a):#1=Open #2=Short
(b):#1=Short #2=Open

MULTIBEAM ANTENNA

CROSS REFERENCE TO RELATED APPLICATIONS

The present invention contains subject matter related to Japanese Patent Application JP 2004-244047 filed in Japanese Patent Office on Aug. 24, 2004, the entire contents of which being incorporated herein by reference.

BACKGROUND OF THE INVENTION

1. Field of the Invention

The present invention relates to a multibeam antenna capable of switching the directivity in multi-directions and is suitably used for a micro communication module implementing an information communication function, storage function, and the like, the micro communication module being attached to various electronic devices such as a personal computer, a mobile phone, or an audio device when used.

2. Description of the Related Art

For example, information such as music, voice, various data, image, or the like along with a recently ongoing progress of digitization of data, becomes easier to handle through the useof a personal computer or a mobile device. Further, such information is band-compressed by a voice codec technology or image codec technology and thereby environment in which the information is easily and effectively distributed to various communication terminals through a digital communication service or digital broadcasting is being put in place. For example, audio/video data (AV data) can be received even by a mobile phone.

For a data transmitting and receiving system, a simple wireless network system applicable even to a small-scale area is now utilized in homes and various locations. As the wireless network system, a 5 GHz narrow-band wireless communication system proposed in IEEE802.1a, a 2.45 GHz wireless LAN system proposed in IEEE802.1b, and a next generation wireless communication system such as a short-range wireless communication system called "Bluetooth" receive a great deal of attention.

In the case of an antenna having no directivity in characteristic direction, there arises a problem that communication quality may deteriorate due to the existence of an interference wave, which is generated at a building wall or the like due to reflection of radio waves in multiple wave environment where many radio waves exist.

Under the above situation, antennas having directivity in specified directions have gotten a lot of attention.

Among them, a phase array antenna using a plurality of phase shifters, and an adaptive array antenna which uses a plurality of transmitting and receiving systems to perform adaptive signal processing are proposed.

Further, as the directional antenna, a Yagi-Uda antenna, which is used for receiving TV broadcast waves and the like is available. As shown in FIG. 1, a Yagi-Uda antenna 100 has a radiator 111 which radiates radio waves, as well as a reflector 112 having a length slightly longer than that of the radiator 111 and a wave director 113 having a length slightly shorter than that of the radiator 111 disposed on both sides of the reflector 111, thereby exhibiting the directivity as shown in FIG. 2 (refer to, for example, Patent Document 1: Japanese Patent Application Laid-Open Publication No. 10-123142).

Further, a directivity control antenna system having directivity in the characteristic direction by arranging a plurality of Yagi-Uda antennas and switching between them is proposed (refer to, for example, Patent Document 2: Japanese Patent Application Laid-Open Publication No. 2003-142919).

SUMMARY OF THE INVENTION

A plurality of systems are required in the case of using the adaptive array antenna, so that the system becomes complicated and expensive. Thus, it is hard to say that the adaptive array antenna is suitable for consumer use.

Further, the antenna apparatus disclosed in Patent Document 1 has the configuration in which a plurality of Yagi-Uda antennas are arranged and, therefore, requires a reflector and a plurality of wave directors, thus preventing miniaturization of the apparatus. In addition, in the antenna apparatus, a monopole antenna projects from a ground plate in the perpendicular direction of a substrate, preventing a reduction is thickness. In the case where the configuration of the antenna apparatus is formed on a printed board adapting dipole configuration in place of monopole configuration, it is difficult to dispose the ground plate near the antenna, making it difficult to implement a changeover switch and the like.

In the multibeam antennas disclosed in Patent Document 2, installation space is shared between the wave director and reflector, in which feeding position is switched to radiate a beam in multi directions. However, there is a a limit to miniaturization. Further, these multibeam antennas radiate a beam in multiple directions, so that it is necessary to provide a changeover switch between a transmitting and receiving system for each beam. These antennas basically have one transmitting and receiving system. Therefore, the changeover switch needs to perform the switching operation in a one-to-plurality manner, making it difficult to use these antennas in the frequency band for a wireless communication.

The present invention has been made in view of the above situation, and it is desirable to reduce the size and thickness of a multibeam antenna capable of switching directivity in multi directions.

The advantages and features of the present invention will be more apparent from the following description taken in conjunction with the accompanying drawings.

According to the present invention, there is provided a multibeam antenna including an antenna element array including one or more feed element and N (N: natural number) parasitic elements, wherein the electrical length of one or more parasitic elements are made variable.

In the multibeam antenna, an impedance converter is mounted on the one or more parasitic elements to make the electrical length of the same variable.

In the multibeam antenna, a reactance element is mounted on the one or more parasitic elements to make the electrical length of the same variable.

In the multibeam antenna, the feed element and N parasitic elements are slot antenna elements.

The multibeam antenna can include a plurality of the antenna element arrays.

In the multibeam antenna according to the present invention, it is possible to realize alternate use of parasitic elements as a wave director and a wave reflector, thereby reducing the size of the antenna apparatus. A switch element necessary to control the directivity is basically mounted on the parasitic element, which has been mounted between the radiator and its feed circuit in the conventional configuration, so that it is possible to reduce the number of switches, with the result that effectiveness of the antenna element is not impaired. Further, when the feed element and N parasitic elements are configured as a slot antenna, further reduction in thickness can be realized. When a dielectric board is used, wavelength reduction effect thereof facilitates miniaturization. Further, the use of a ground board makes it easy to mount a switch for the switching and the like.

BRIEF DESCRIPTION OF THE DRAWINGS

FIG. 11A shows a change of the maximum radiation direction in the case where a capacitor is used as the reactance element, and FIG. 11B shows a change of the maximum radiation direction in the case where an inductor is used as the reactance element;

DETAILED DESCRIPTION OF THE PREFERRED EMBODIMENTS

An embodiment of the present invention will be described below in detail with reference to the accompanying drawings.

A basic configuration of a multibeam antenna according to the present invention is shown in FIG. 3.

Figure 1:
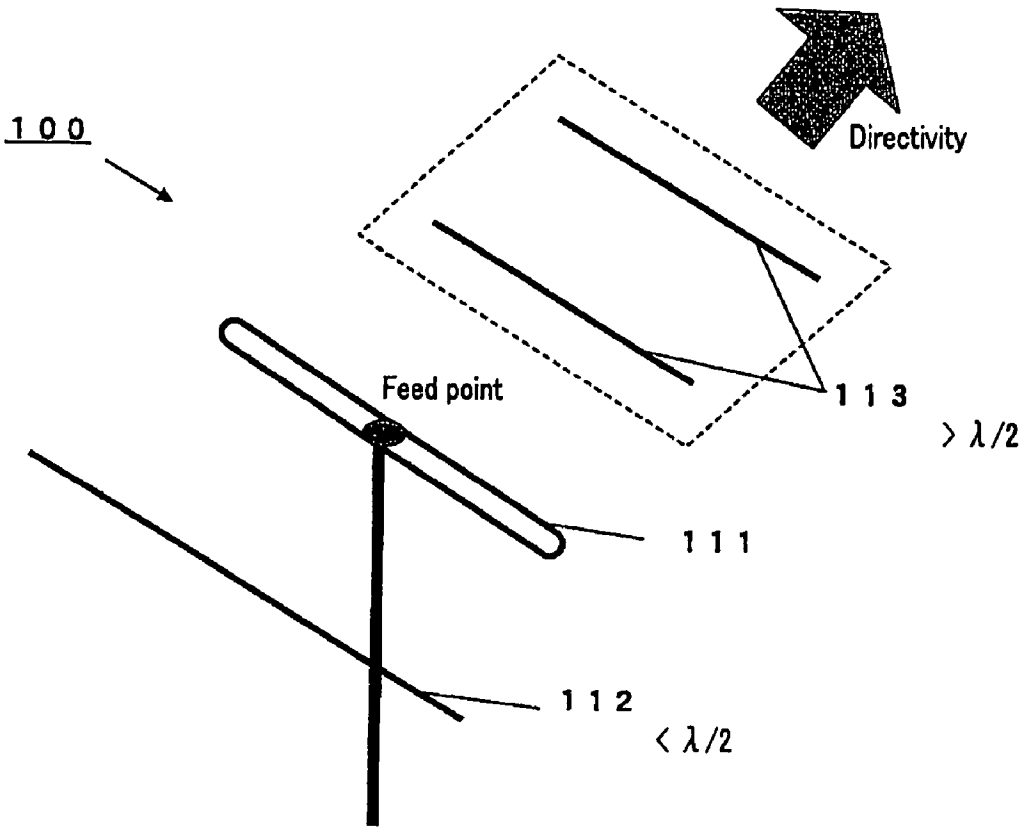
FIG. 1 is a perspective view schematically showing, as a directional antenna, a configuration of a Yagi-Uda antenna used fro receiving TV broadcasting.
Figure 2:
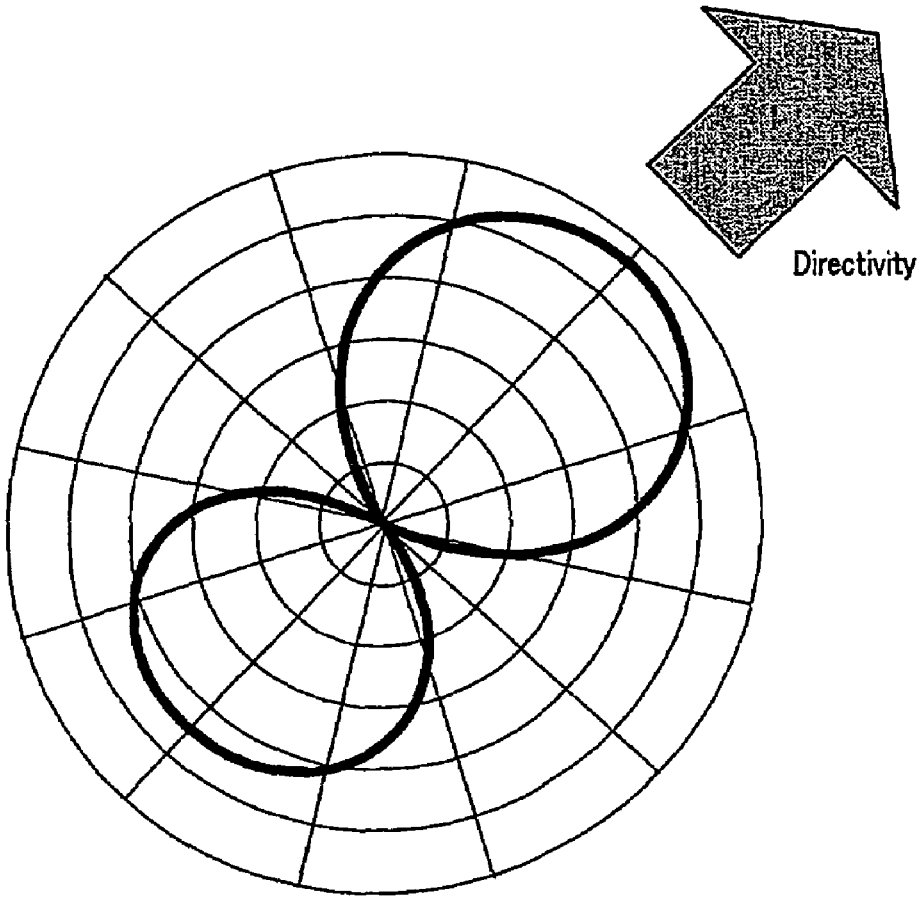
FIG. 2 is a radiation pattern view showing the directivity characteristics of the Yagi-Uda antenna.
Figures 3A, 3B, 3C:
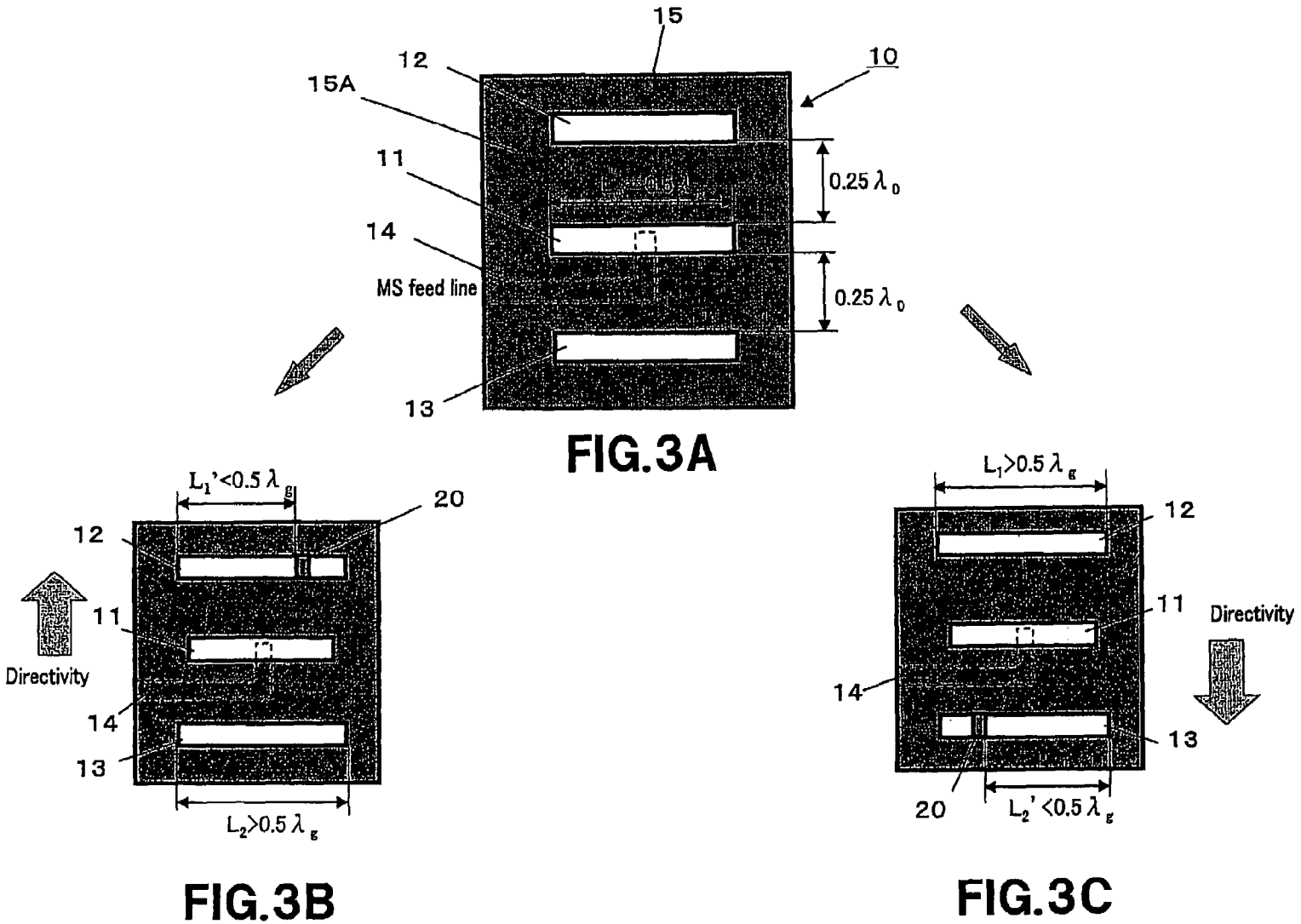
FIGS. 3A to 3C are plan views each schematically showing a basic configuration of a multibeam antenna according to the present invention.

As shown in FIG. 3A, a multibeam antenna 10 shown in FIG. 3, which is obtained by modifying a Yagi-Uda antenna into a slot configuration, has an antenna element array including one feed element 11 and two parasitic elements 12 and 13. A switching element 20 for switching the electrical lengths of the parasitic elements 12 and 13 is provided as shown in FIGS. 3B and 3C to make the electrical lengths thereof variable, thereby enabling switching of the directivity in two directions.

A slot antenna is just a slot (usually about ½ wavelength long) in a conductor (ground surface).

As shown in FIG. 3A, the slot antenna formed on a ground surface 15A of a double-sided printed board 15 is fed by electromagnetic coupling using a microstripline 14 formed on a surface facing the ground surface 15A to thereby function as a radiating slot that radiates radio waves, that is, the feed element 11.

The slot antenna, or the feed element 11 has a resonance frequency changed depending on the dielectric constant of the base material of the printed board 15. Parasitic slots, or parasitic elements 12 and 13 are disposed away from the radiating slot, or the feed element 11 by about ¼ wavelength (0.25 λo). When the lengths $L_1$ and $L_2$ of the parasitic elements 12 and 13 are made shorter than the length $L_0$ (about ½ wavelength (0.5 λo)) of the radiating slot, the parasitic elements 12 and 13 function as wave directors; whereas when the lengths $L_1$ and $L_2$ of the parasitic elements 12 and 13 are made longer than the length $L_0$ (about ½ wavelength (0.5 λo)) of the radiating slot, the parasitic elements 12 and 13 function as reflectors. With the above configuration, the multibeam antenna 10 can serve in a way comparable to a Yagi-Uda antenna of a general type. Therefore, it is possible for the multibeam antenna 10 to have radiation directivity in a specified direction by disposing the reflector and wave director on both sides of the feed element 11.

FIGS. 4 to 7 show radiation pattern characteristics of the Yagi-Uda slot array antenna having the above configuration in the case where the lengths of the wave director and wave reflector are changed by a pattern of the printed board 15.

Figure 4A:
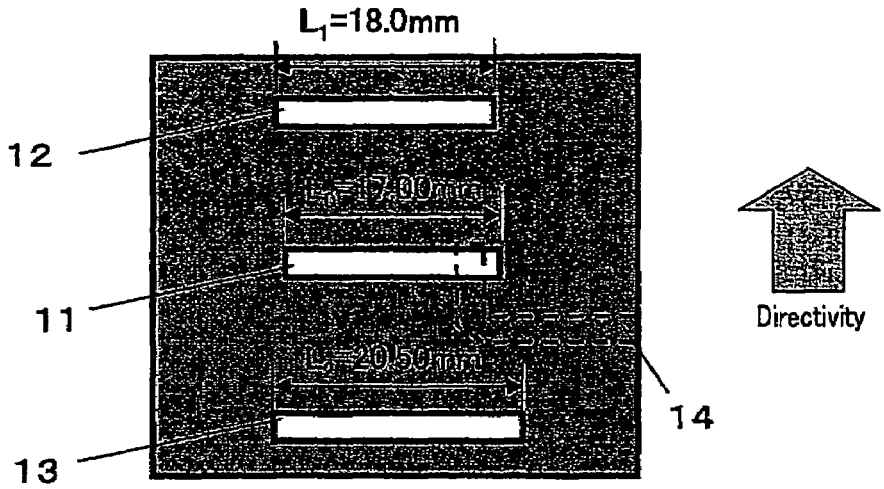
FIG. 4A is a plan view schematically showing a Yagi-Uda slot array antenna in which the lengths of the wave director and reflector are changed by a pattern of printed board.
Figure 4B:
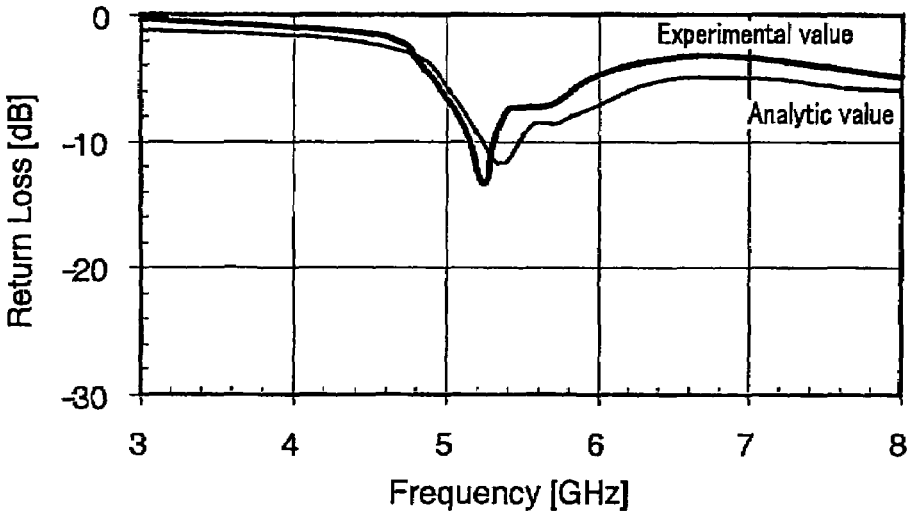
FIG. 4B is a view showing input characteristics thereof.
Figure 5A:
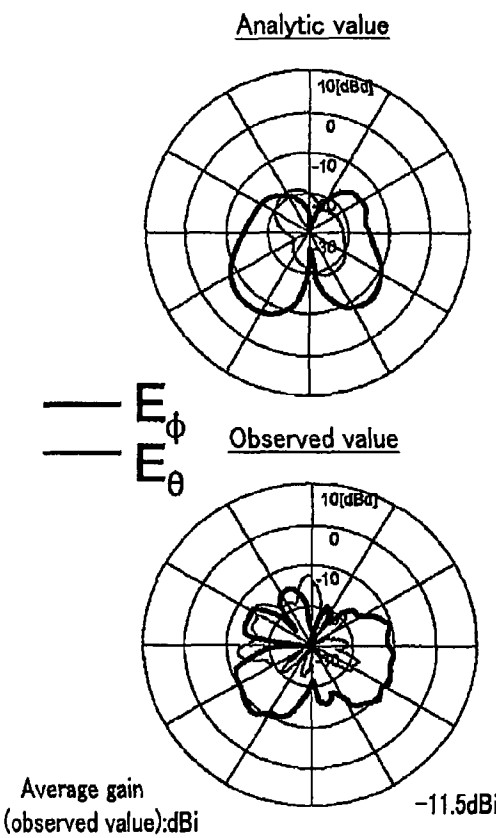
FIGS. 5A to 5C are radiation pattern views showing the directivity characteristics of the Yagi-Uda slot array antenna shown in FIG. 4.
Figure 5B:
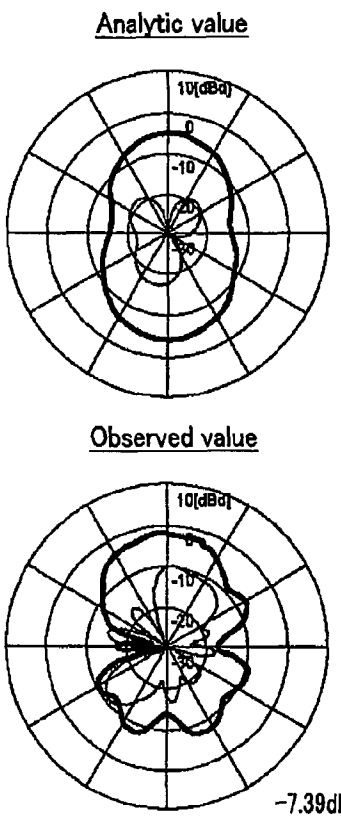

As the printed board, a 40 mm square FR-4 board having a thickness of 1 mm is used. Slot widths of all elements are set to 2 mm, and slot lengths of the wave director (parasitic element 12), radiator (feed element 11), and reflector (parasitic element 13) are set to 18 mm ($L_1$), 17 mm ($L_0$), and 20.5 mm ($L_2$) in the order mentioned. This Yagi-Uda slot array antenna exhibits input characteristics as shown in FIG. 4B. As can be seen from FIG. 4B, the Yagi-Uda slot array antenna resonates when the length of the radiator (feed element 11) becomes about ½ wavelength of a pipe wavelength λg. The directivity characteristics of the Yagi-Uda slot array antenna is shown in FIGS. 5A to 5C.

Figure 6A:
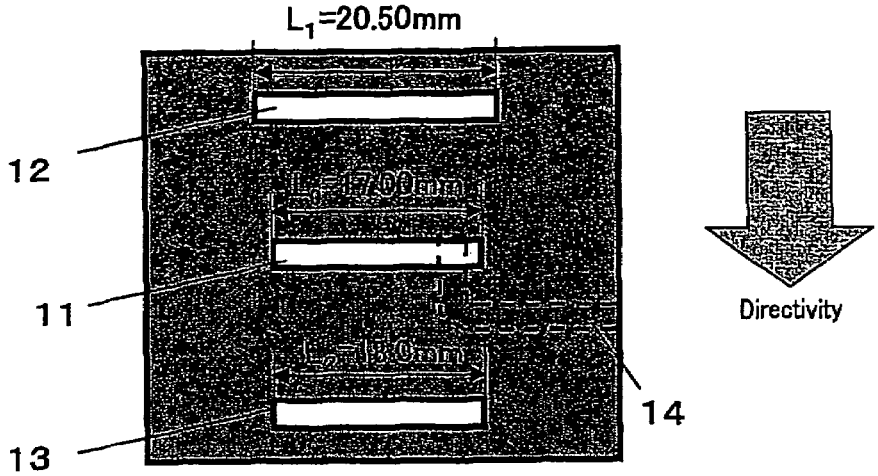
FIG. 6A is a plan view schematically showing a Yagi-Uda slot array antenna in which the wave director and reflector are placed in reverse positions.
Figure 6B:
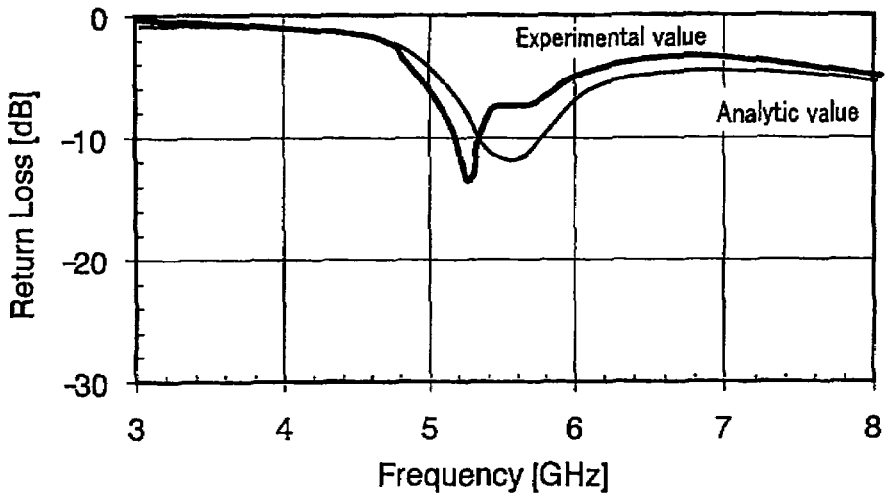
FIG. 6B is a view showing input characteristics thereof.
Figures 7A, 7B, 7C:
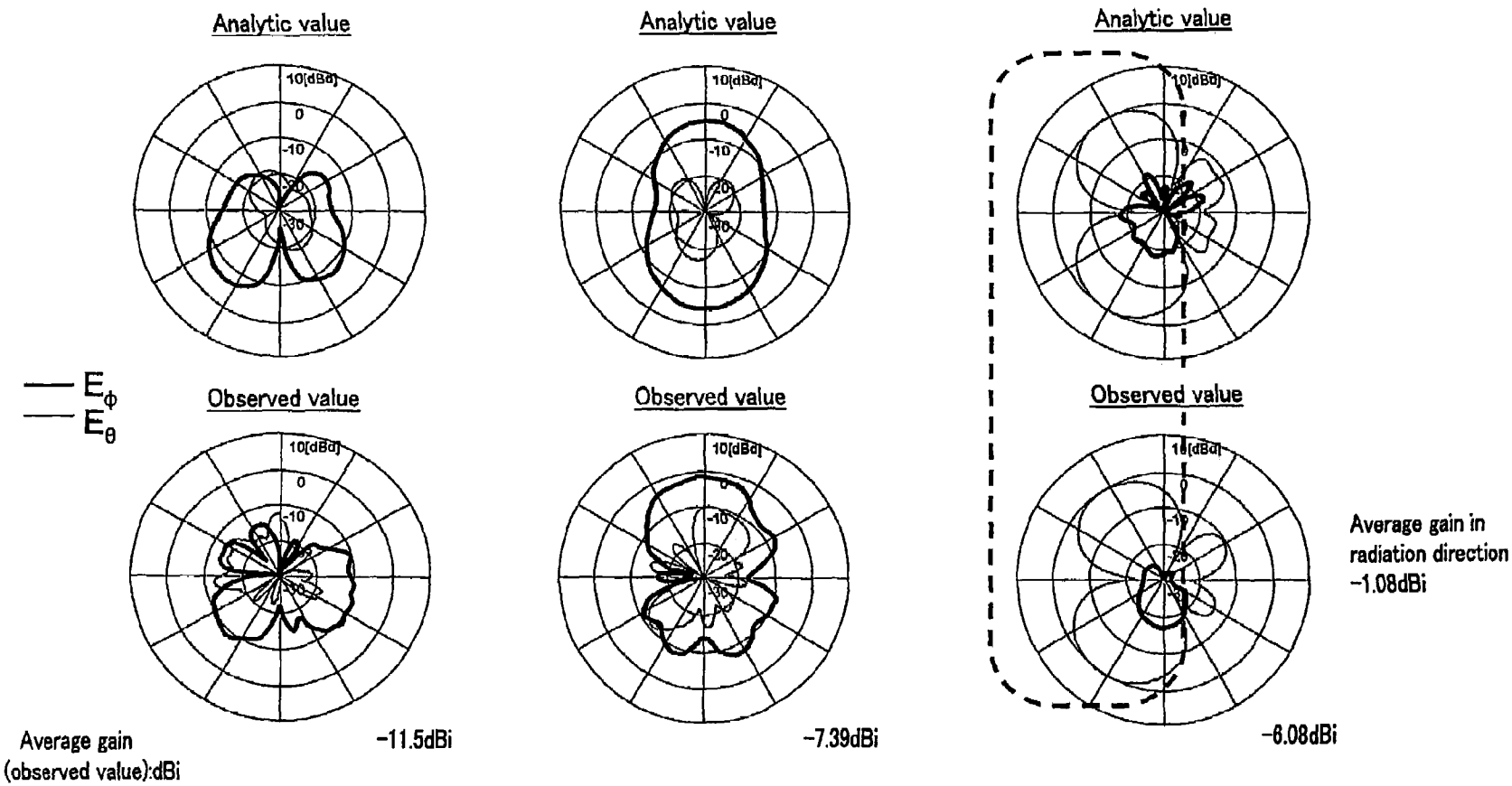
FIGS. 7A to 7C are radiation pattern views showing the directivity characteristics of the Yagi-Uda slot array antenna shown in FIG. 6.

The Yagi-Uda slot array antenna shown in FIG. 6A, in which the wave director and reflector are placed in reverse positions exhibits input characteristics as shown in FIG. 6B and directivity characteristics as shown in FIGS. 7A to 7C.

Figure 5C:
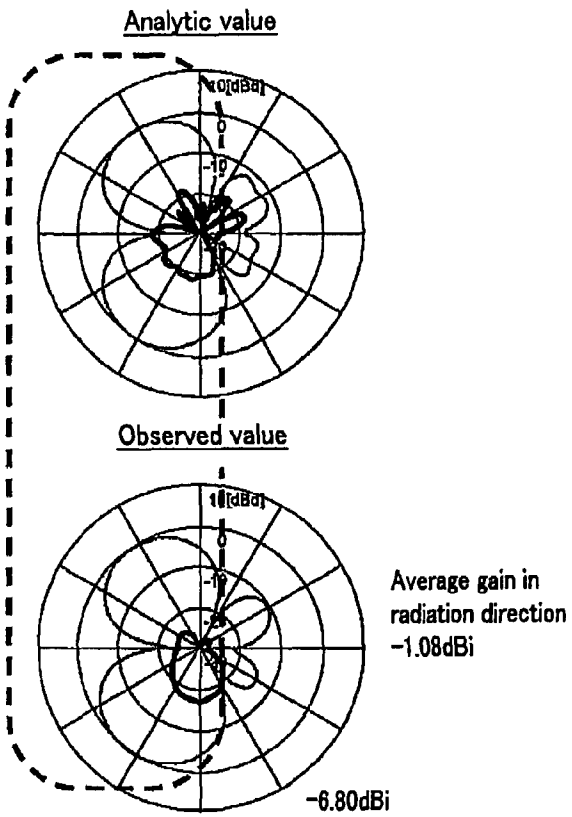

As can be seen from the directivity characteristics of YZ-plane shown in FIGS. 5C and 7C, the directivity can be controlled by the wave director and reflector.

FIGS. 5A to 5C and 7A to 7C show directivity characteristics by plotting the analytic and experimental values of the gain on XY-plane, XZ-plane, and the YZ-plane, in which the longitudinal direction of the slots is set to X-direction, arranging direction of the slots is set to Y-direction, and direction perpendicular to the X and Y-directions perpendicular to the X and Y-directions is set to Z-direction.

As described above, in the Yagi-Uda slot array antenna, disposition of the wave director slot and reflector slot allows the antenna to have directivity. Accordingly, by replacing the position of the wave director slot and reflector slot, the antenna can obtain symmetrical directivity. Therefore, switching of the lengths of the parasitic elements disposed on both sides of the radiation slot allows the parasitic elements to function as a wave director slot and reflector slot to thereby switch the directivity.

Figure 8A:
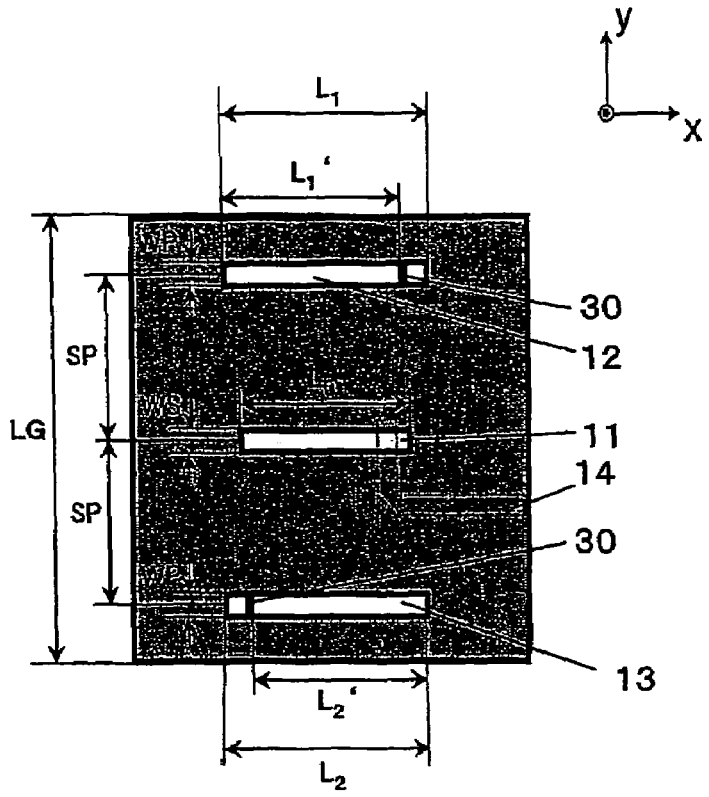
FIG. 8A is a plan view schematically showing a configuration of a Yagi-Uda slot array antenna in which a short PIN is provided for a parasitic slot.
Figure 8B:
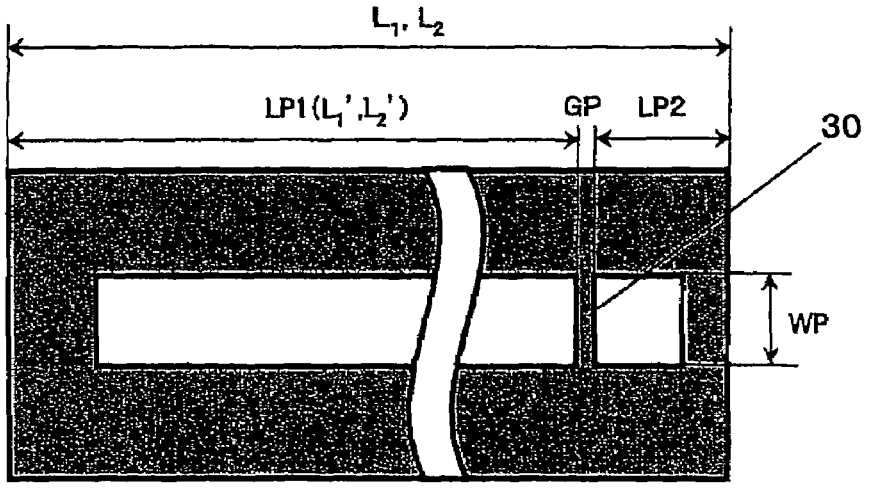
FIG. 8B is an enlarged view of a part of the parasitic slot.

For example, as shown in FIGS. 8A and 8B, parasitic slots (parasitic elements 12 and 13) having a slot length (LP1+LP2+GP) of 20.5 mm and thereby functioning as reflectors are disposed on both sides of a radiation slot (feed element 11) having a slot length LS of 17 mm, and a short PIN 30 is disposed at the specified position (slot length LP1=18.5 mm) of one parasitic slot. Then, the parasitic slot for which the short PIN 30 is provided functions as a wave director. By this, the Yagi-Uda slot array antenna operates.

Figure 9:
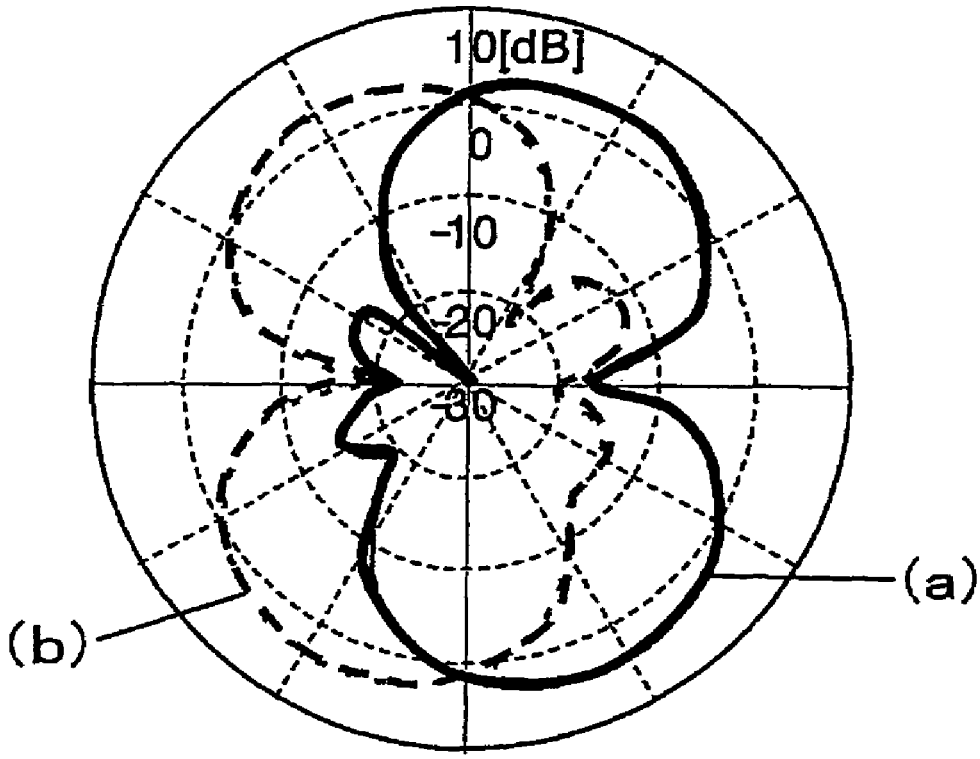
FIG. 9 is a radiation pattern view showing the directivity characteristics of the Yagi-Uda slot array antenna shown in FIG. 8.

FIG. 9 shows the analytic value of the directivity on YZ-plane in the case where the short PIN 30 is provided for one of the parasitic slots. In FIG. 9, (a) is the directivity characteristics obtained in the case where the short PIN 30 is provided for the parasitic slot #1, or parasitic element 12; and (b) is directivity characteristics obtained in the case where the short PIN 30 is provided for the parasitic slot #2, or the parasitic element 13. It can be seen, from FIG. 9, that the directivity has been switched.

The above Yagi-Uda slot array antenna switches the lengths of the wave directors and reflectors by a pattern of the parasitic elements 12 and 13 formed on the printed board 15. Alternatively, however, it is possible to switch the functions of a wave director and reflector by providing a reactance element for the parasitic slot. That is, by disposing a reactance element, in place of the short PIN, at the position that divides the length of the parasitic slot into LP1 and LP2, it is possible to switch the directivity of the Yagi-Uda slot array antenna.

Figure 10A:
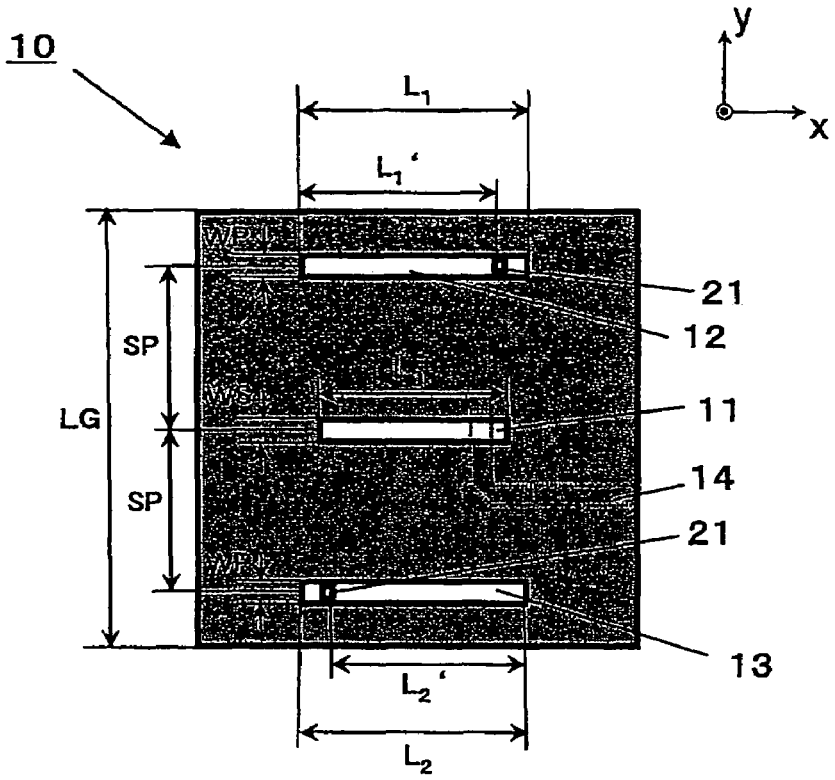
FIG. 10A is a plan view schematically showing a configuration of a multibeam antenna in which a reactance element is provided for a parasitic slot for switching the functions of a wave director and reflector.
Figure 10B:
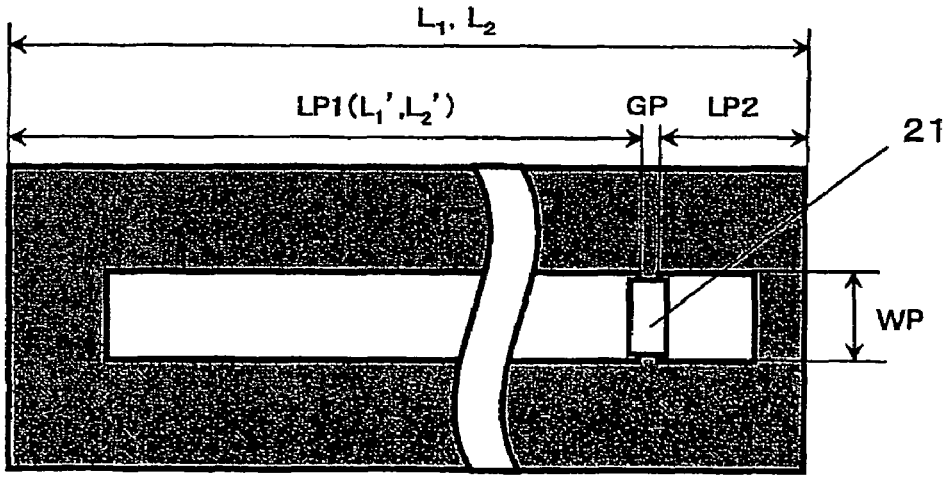
FIG. 10B is an enlarged view of a part of the parasitic slot.

More concretely, as shown in FIGS. 10A and 10B, the parasitic elements 12 and 13 are previously formed by slots each having the same length of the reflector, and reactance elements 21 are disposed, as the switching elements 20, at the position corresponding to the wave director length, thereby enabling the switching of the functions of a wave director and reflector.

Figure 11A:
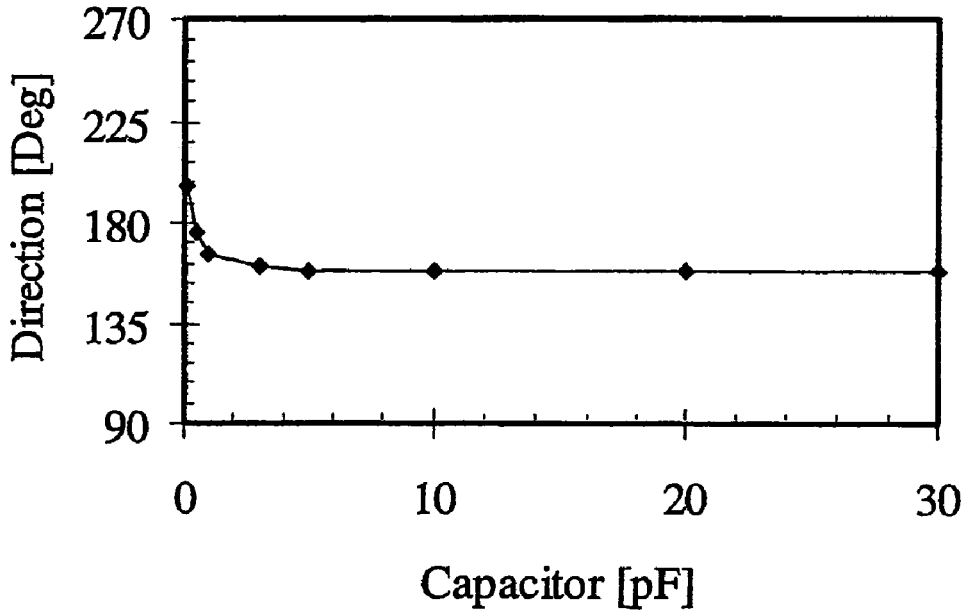
FIGS. 11A and 11B are views showing an analysis result of the directivity of XZ-plane in the multibeam antenna shown in FIG. 10.
Figure 11B:
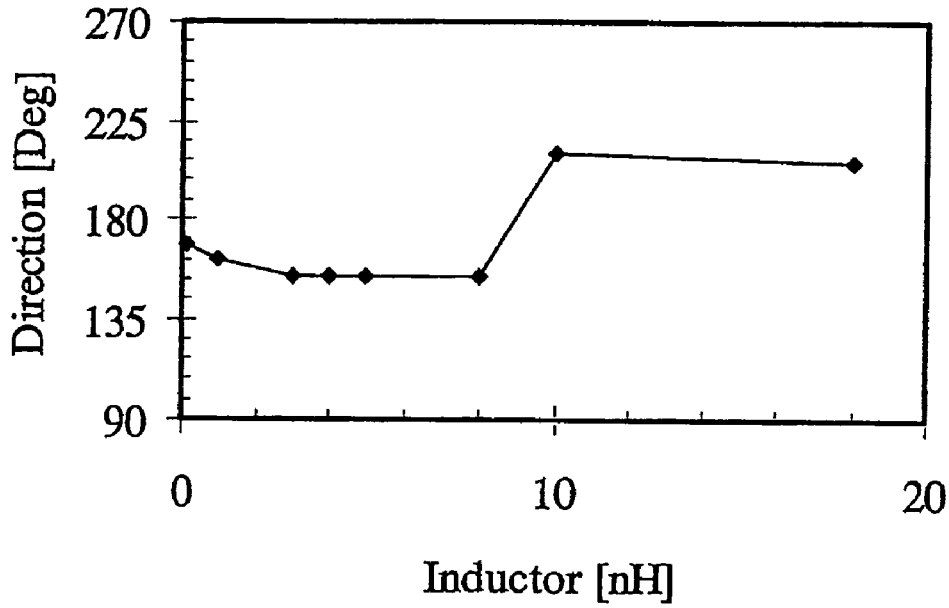

FIGS. 11A and 11B each shows an analytic result of a change of the directivity on XZ-plane in the case where the reactance elements 21 are disposed, as the switching elements 20, at the position that divides the slot length of the parasitic slots (parasitic elements 12 and 13) into LP1 ($L_1'$, $L_2'$) and LP2. FIG. 11A shows a change of the maximum radiation direction in the case where a capacitor is used as the reactance element 21, and FIG. 11B shows a change of the maximum radiation direction in the case where an inductor is used as the reactance element 21. The constant numbers of FIGS. 11A and 11B show the change of the directivity.

In either case of using the capacitor or inductor as the reactance element 21, when a part having a low impedance level under the designed frequency is disposed, magnetic current excited on the parasitic slot is not weakened. That is, this case is equivalent to the case where the slot is opened, with the result that the parasitic slot functions as a reflector. On the other hand, when a part having a high impedance level is disposed, the path of magnetic current excited on the parasitic slot is cut at that position. That is, this case is equivalent to the case where the slot is short-circuited by the part, and, therefore, the magnetic current does not exist on LP2 side, with the result that the parasitic slot functions as a wave director. In either case, under the designed frequency, the parasitic slot functions as a reflector in the case of low impedance; whereas the parasitic slot functions as a wave director in the case of high impedance.

Figure 12:
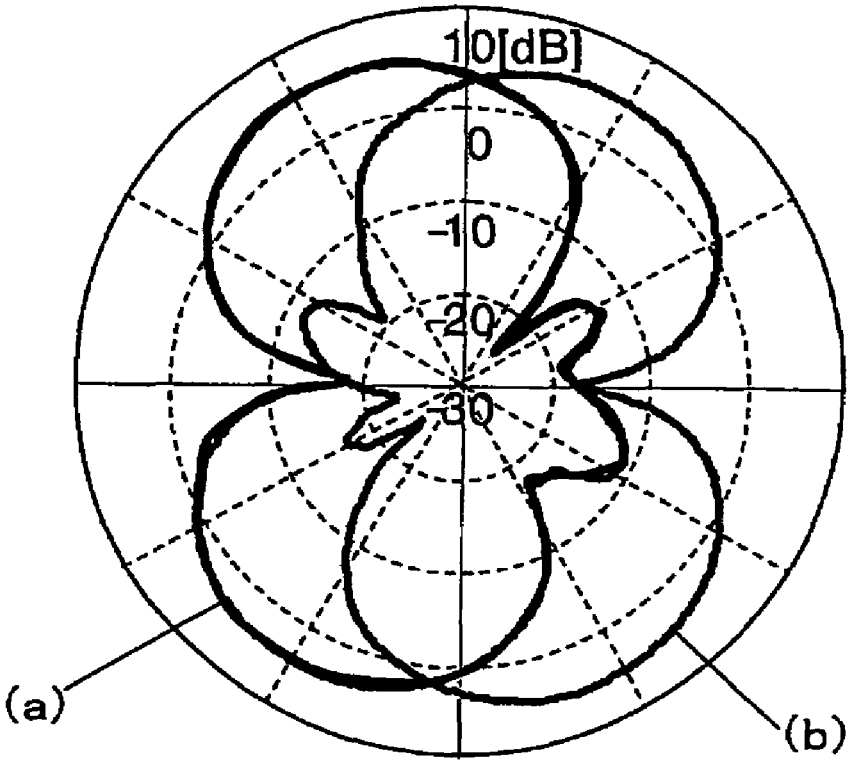
FIG. 12 is a radiation pattern view showing the directivity characteristics of the multibeam antenna in which a capacitor is used as the reactance element.

FIG. 12 is a radiation pattern view showing the directivity on YZ-plane in the case where the reactance elements are disposed at the position that divides the slot lengths of the parasitic slot into LP1 ($L_1'$, $L_2'$) and LP2. As described above, adequate selection of the constant number allows the parasitic slots to function both as a wave director and reflector, thereby constituting the Yagi-Uda slot array antenna. In FIG. 12, (a) is directivity characteristics obtained in the case where a 0.5 pF capacitor is provided for the parasitic slot #1, or parasitic element 12 and a 18 pF capacitor is provided for the parasitic slot #2, or parasitic element 13 is provided; and (b) is the directivity characteristics obtained in the case were a 18 pF capacitor is provided for the parasitic slot #1, or parasitic element 12 and a 0.5 pF capacitor is provided for the parasitic slot #2, or parasitic element 13 is provided. It can be seen, from FIG. 12, that the directivity has been switched.

Further, also in the case where a varicap or MEMS switch is disposed in place of the discrete parts, it is possible to switch the operation of the parasitic slots between a wave director and reflector, depending on the impedance value changing with a voltage. That is, it is possible to switch the directivity. With the configuration as described above, it is possible to realize alternate use of the wave director and reflector completely, thereby reducing the size of the antenna apparatus.

Figure 13A:
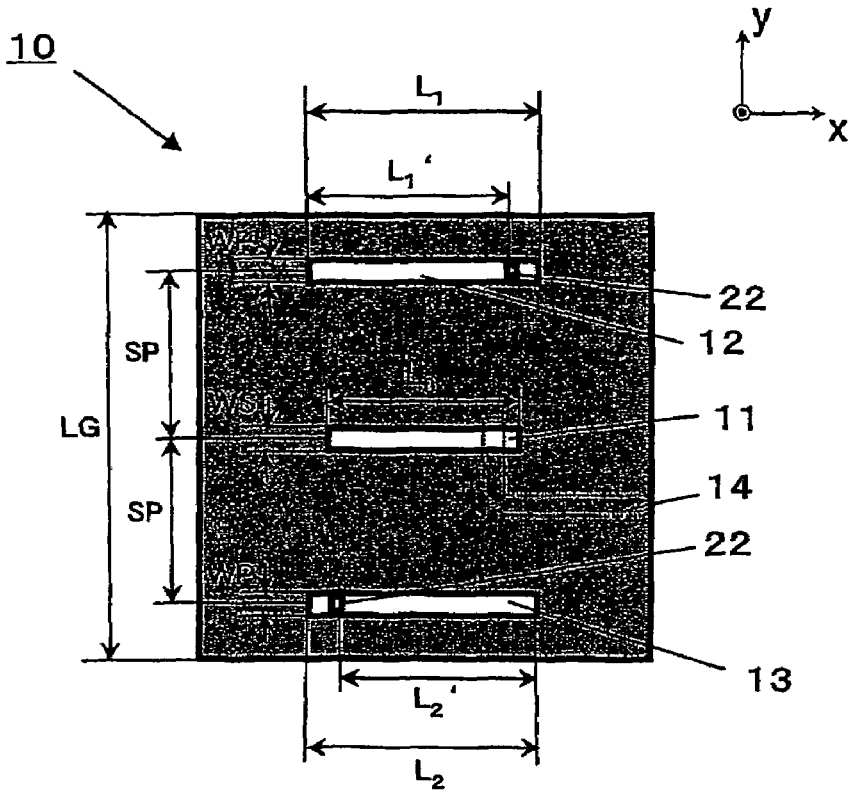
FIG. 13A is a plan view schematically showing a configuration of a multibeam antenna in which an impedance converter is provided for a parasitic slot for switching the functions of a wave director and reflector.
Figure 13B:
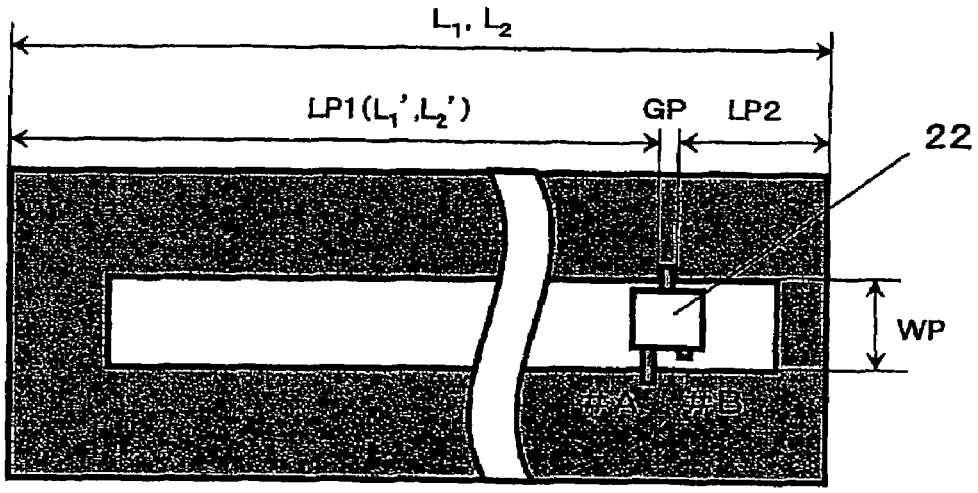
FIG. 13B is an enlarged view of a part of the parasitic slot.

Further, in the Yagi-Uda slot array antenna, also in the case where an impedance converter 22 is disposed, in place of the reactance element 21, at the position that divides the slot length of the parasitic slots (parasitic elements 12 and 13) into LP1 ($L_1'$, $L_2'$) and LP2, as shown in FIGS. 13A and 13B, it is possible to switch the operation of the parasitic slots between a wave director and a wave reflector.

As the impedance converter 22, an MMIC (monolithic microwave integrated circuits) SPDT (single pole double throw switch) switch (hereinafter, referred to as merely "MMIC switch") is mounted, for example.

The MMIC switch contains a reactance element other than an FET and, therefore, cannot operate simply as a changeover switch. In the Yagi-Uda slot array antenna, when the reactance component of the parasitic slots (parasitic elements 12 and 13) is capacitive, the parasitic slots function as wave directors; whereas, when the reactance component is inductive, the parasitic slots function as reflectors. As described above, it is possible to switch the operation of the parasitic slots between a wave director and reflector depending on whether combined reactance component of the slot and MMIC switch is capacitive or inductive.

In the case where the MMIC switch is mounted on each of the parasitic elements 12 and 13, #A port of the switch is short-circuited to the slot line, and a #B port is opened. The impedance of the parasitic slot (parasitic slot 12 or 13) with the MMIC switch can be represented by the following expressions (1) to (5).

[Numeral 1]

$$Z_{Lp2} = jZ\tan(K_z LP2) \quad \text{expression (1)}$$

[Numeral 2]

$$Z_{SWLP2} = Z_{SW} + Z_{LP2} \quad \text{expression (2)}$$

[Numeral 3]

$$Z_p = \frac{Z_{SWLP2} + jZ\tan(k_Z LP1)}{Z + jZ_{SWLP2}\tan(k_Z LP1)} \quad \text{expression (3)}$$

[Numeral 4]

$$\mathrm{Im}(Z_P) < 0 \quad \text{expression (4)}$$

[Numeral 5]

$$\mathrm{Im}(Z_P) > 0 \quad \text{expression (5)}$$

$Z_p$: parasitic slot impedance $Z_{LPn}$: parasitic slot impedance (length: n)

$Z_{SW}$: MMIC switch impedance $Z_{SWLP2}$: combined impedance (SW+LP2)

When the lengths LP1 ($L_1'$, $L_2'$) and L2 are determined by switching (open and short) of the impedance of the MMIC switch so as to satisfy the conditions of expressions (4) and (5), it is possible to switch the operation of the parasitic elements 12 and 13 between a wave director and reflector.

Figure 14:
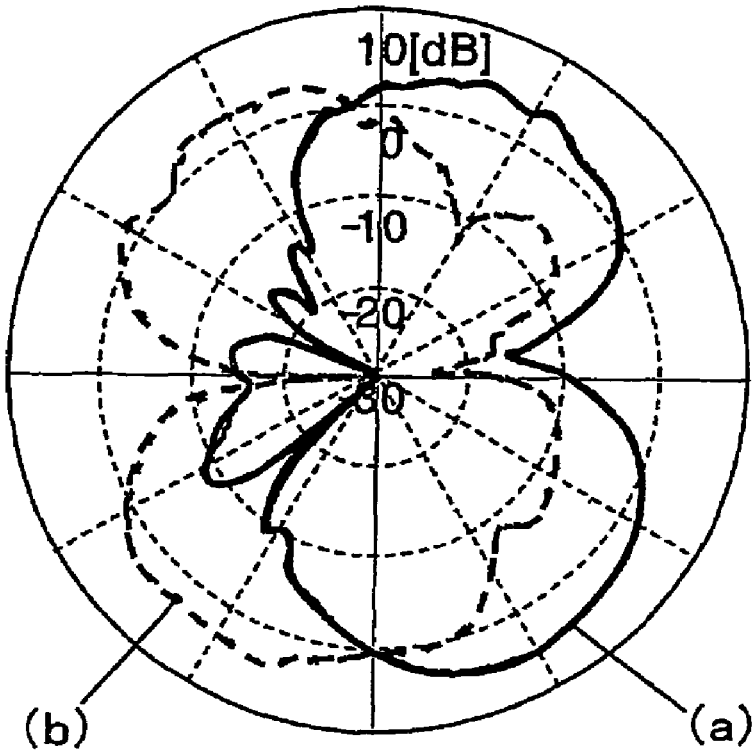
FIG. 14 is a radiation pattern view showing the directivity characteristics of the multibeam antenna shown in FIG. 13.

FIG. 14 shows an observed value of the directivity on YZ-plane in the case where MMIC switches (NEC uPG2022TB, Open: 10-j100Ω, Short: 47+5jΩ) are mounted, as the switching element 20, on the two parasitic slots (parasitic elements 12 and 13). In FIG. 14, (a) is directivity characteristics obtained in the case where the switch mounted on the parasitic slot #1, or parasitic element 12 is opened and the switch mounted on the parasitic slot #2, or parasitic element 13 is short-circuited, and (b) is directivity characteristics obtained in the case where the switch mounted on the parasitic slot #1, or parasitic element 12 is short-circuited and the switch mounted on the parasitic slot #2, or parasitic element 13 is opened. It can be seen, from FIG. 14, that the directivity has been switched by the switching of the impedance of the MMIC switch. That is, the functions of a wave director and a wave reflector are switched by the MMIC switch to allow the alternate use of the parasitic slots (parasitic elements 12 and 13), thereby reducing the size of the antenna apparatus. The radiation slot (feed element 11) is not provided with a switch and a phase shifter such as one included in a phased array antenna. Therefore, the function of the radiation element is not impaired. Further, since the feed element 11, parasitic elements 12 and 13 are formed on the ground surface 15A, the thickness of the elements itself corresponds to the thickness of the printed board 15, leading to reduction in the thickness of the antenna apparatus. Further, the influence of the switching operation on the antenna elements is small, making it easy to mount the switching element.

The abovementioned Yagi-Uda slot array antenna is a multibeam antenna 10 capable of switching the directivity only in two (forward and backward) directions. When the antenna element arrays shown in FIG. 3A are so disposed as to cross each other at right angles as shown in FIG. 15, a multibeam antenna 110 capable of switching the directivity in four directions can be obtained.

Figure 15:
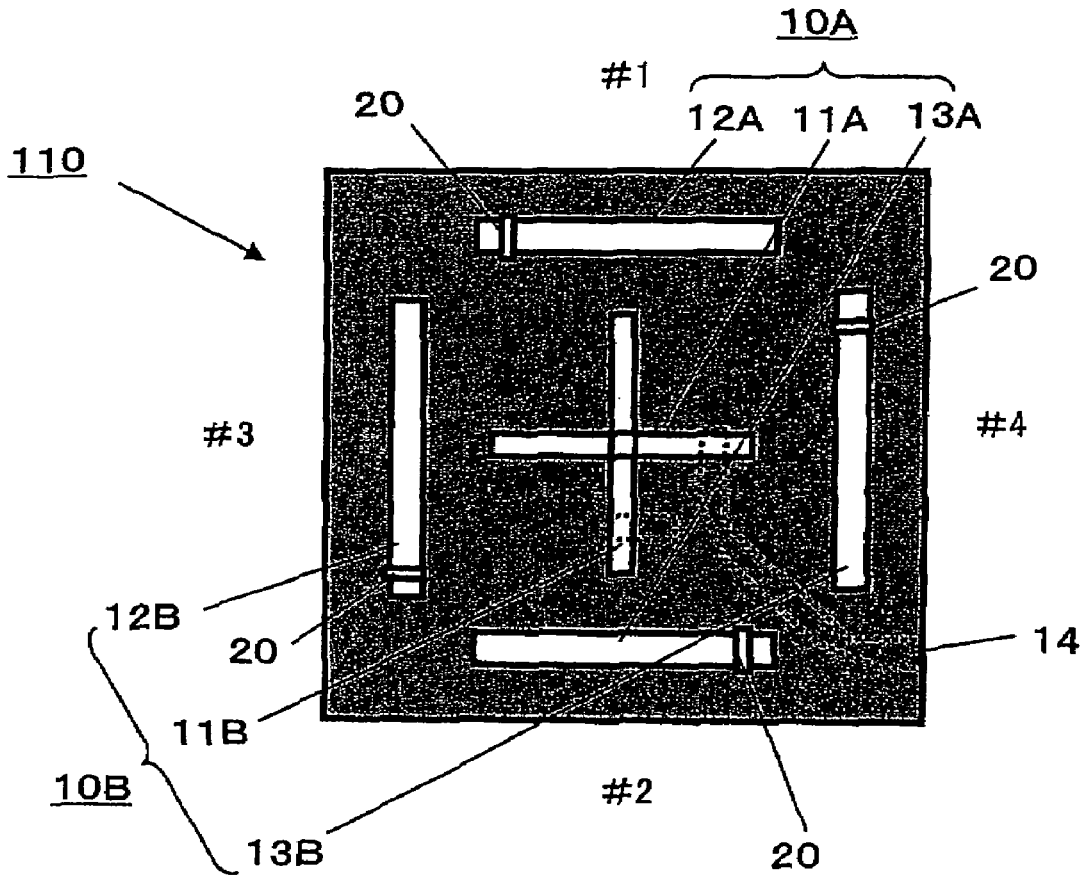
FIG. 15 is a plan view schematically showing a configuration of a multibeam antenna capable of switching the directivity in four directions.

The multibeam antenna 110 shown in FIG. 15 has an antenna element array 10A including one feed element 11A and two parasitic elements 12A and 13A as well as an antenna element array 10B disposed perpendicular to the antenna element array 10A, including one feed element 111B and two parasitic elements 12B and 13B, in which a radiation slot functioning as the feed elements 11A and 11B is formed by a cross slot, and a power feed to the cross slot, or feed elements 11A and 111B through a microstripline 14 is switched by a switch, thereby constituting a Yagi-Uda cross slot antenna capable of switching the directivity in forward and backward directions (#1 and #2), and left and right directions (#3 and #4).

Figure 16:
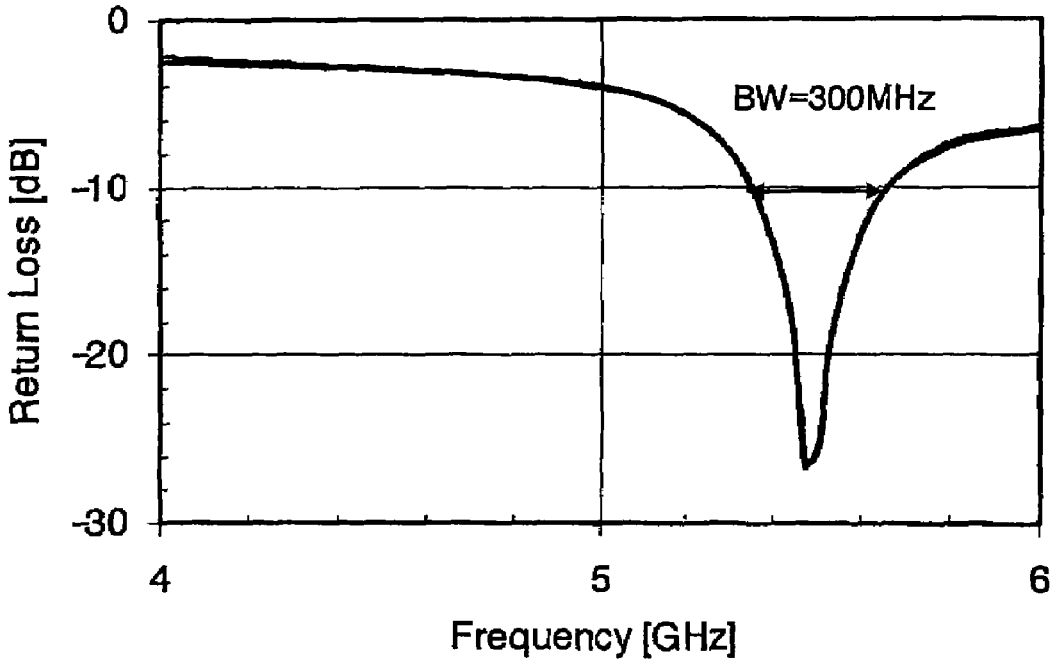
FIG. 16 is a view showing input characteristics in the case where the electrical lengths of respective parasitic elements are switched by a reactance element to allow the parasitic elements to function as a wave director and reflector in the multibeam antenna shown in FIG. 15.
Figures 17A, 17B, 17C, 17D:
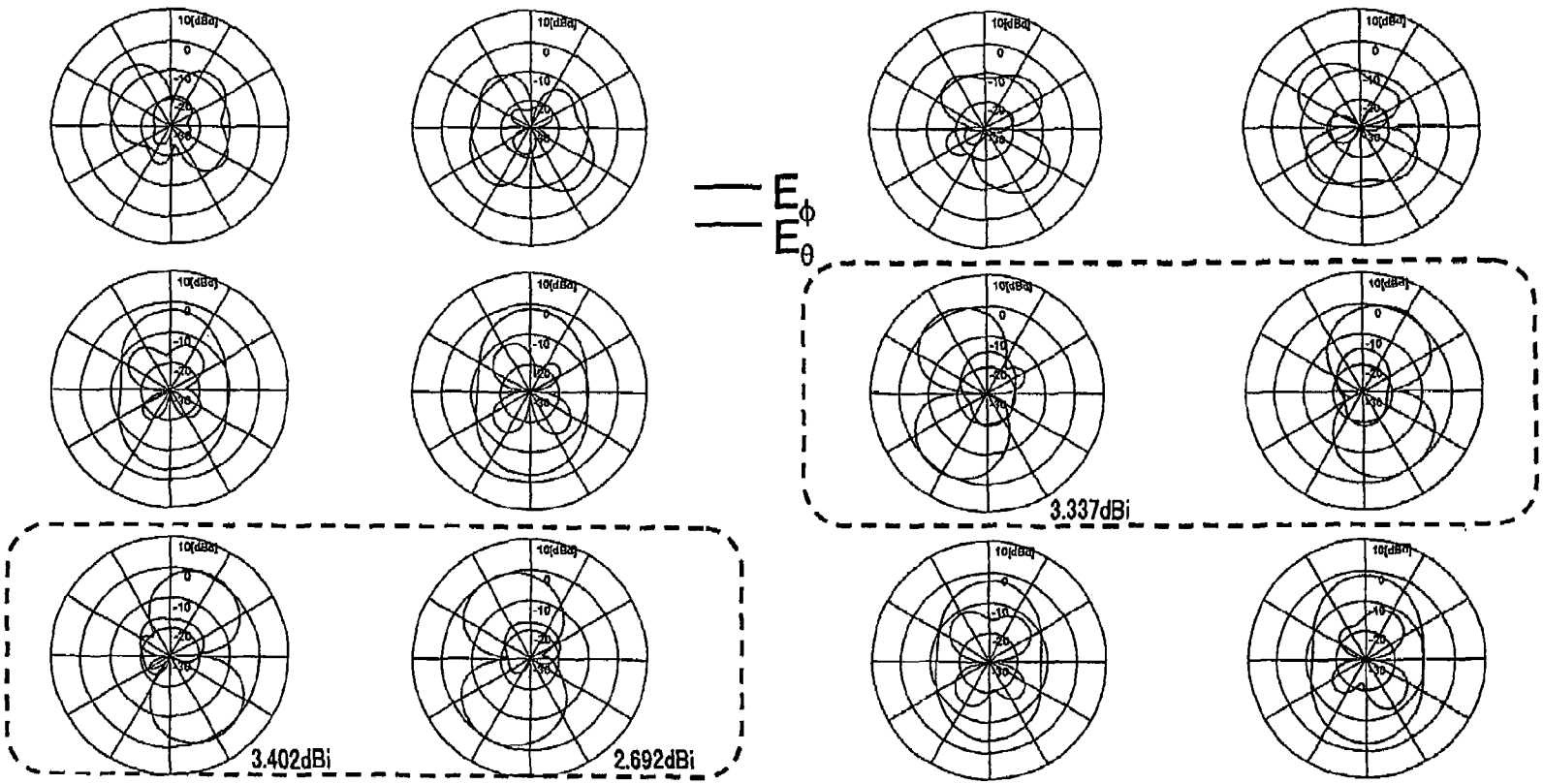
FIGS. 17A to 17D are radiation pattern views showing the directivity characteristics of the multibeam antenna in four directions in the case where the electrical lengths of respective parasitic elements in the multibeam antenna are switched by a reactance element to allow the parasitic elements to function as a wave director and reflector.

FIG. 16 is a view showing input characteristics in the case where the electrical lengths of respective parasitic elements 12A, 13A, 12B and 13B are switched by the reactance element 21 to allow the parasitic elements to function as a wave director and reflector in the multibeam antenna 110. FIGS. 17A to 17D are directivity characteristics in four directions (#1, #2, #3, and #4) in the above case.

It can be seen, from the input characteristics shown in FIG. 16, that the fractional bandwidth of the multibeam antenna 110 is about 5%. Further, as is clear from the directivity characteristics shown in FIG. 17, directivity can be controlled in four directions in the multibeam antenna 110.

The average gain of the multibeam antenna 10 is shown in Table 1. There is an average gain difference of at least 3 dB or more between radiation direction and other directions. Accordingly, the maximum gain obtained in reception/detection indicates the radiation direction. Thus, the transmission of radio waves in that direction can suppress unnecessary radio waves.

TABLE 1

| | Slot #1 | Slot #2 | Slot #3 | Slot #4 |
|---|---|---|---|---|
| Maximum gain [dBi] | 2.33 | 1.67 | 2.4 | 1.69 |
| Average gain (XY-plane) | −10.95 | −9.87 | −10.9 | −8.96 |
| Average gain (XZ-plane) | −6.12 | −5.29 | −7.84 | −7.32 |
| Average gain (YZ-plane) | −8.15 | −6.05 | −6.32 | −5.29 |
| Average gain (radiation direction) | −1.46 | −2.75 | −1.52 | −2.95 |
| Half-power angle | 56° | 52° | 55° | 56° |

Gain comparison analytic value (calculate on SW insertion loss of 1 dB)

Figure 18:
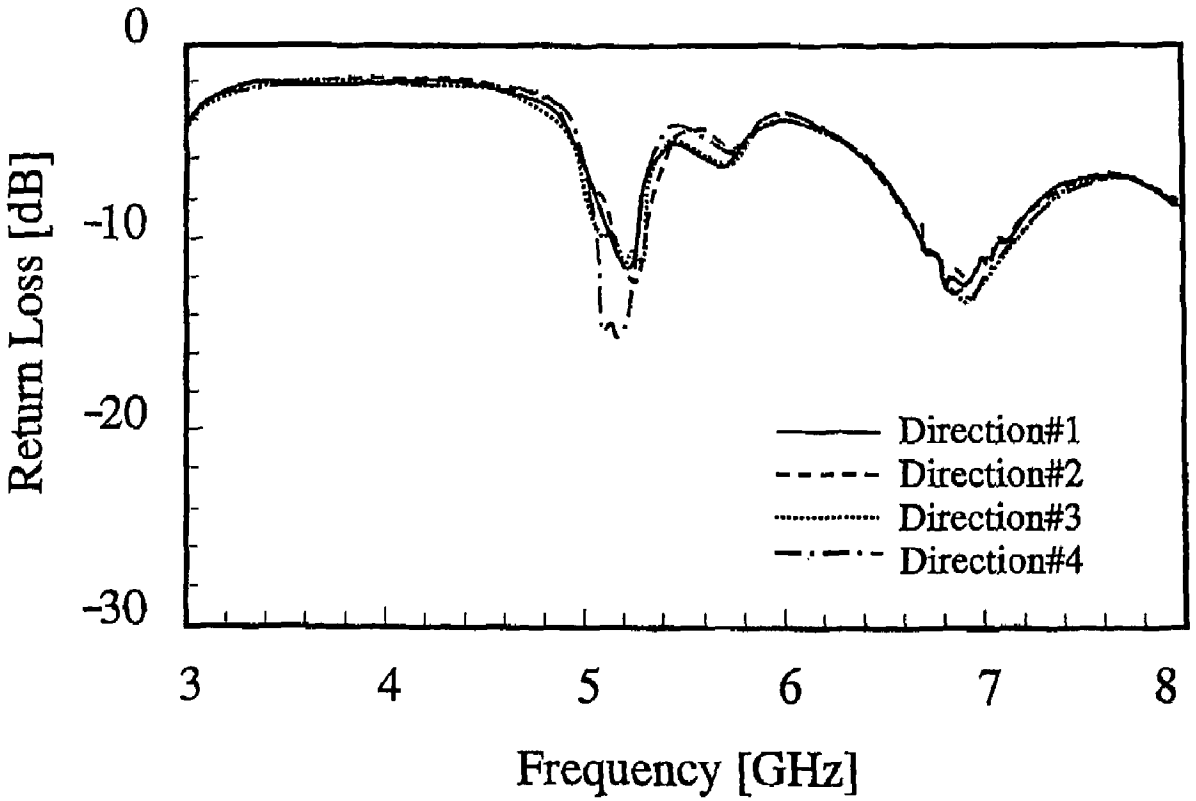
FIG. 18 is a view showing input characteristics in the case where the electrical lengths of respective parasitic elements are switched by an impedance converter to allow the parasitic elements to function as a wave director and reflector in the multibeam antenna shown in FIG. 15.
Figure 19A:
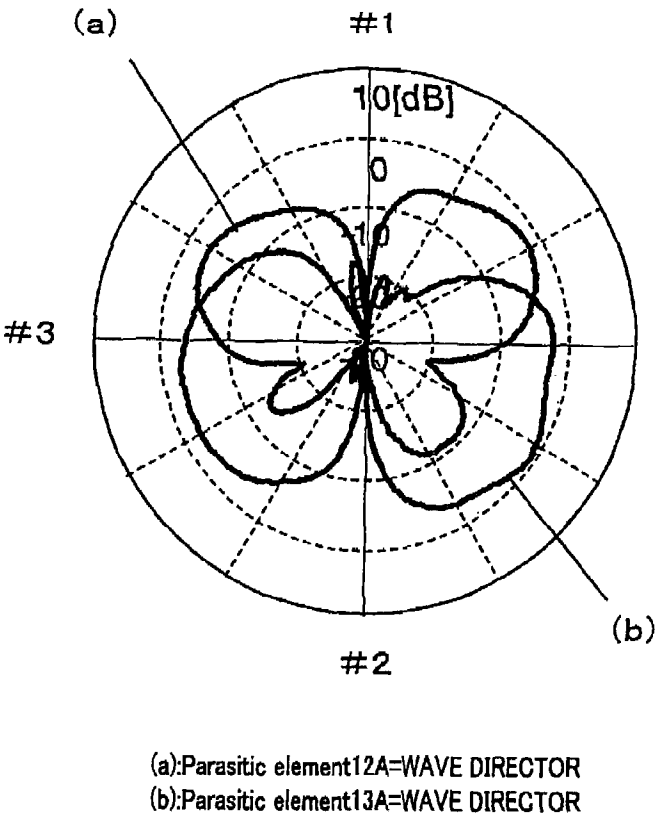
FIGS. 19A and 19B are radiation pattern views showing the directivity characteristics of the multibeam antenna in the case where the electrical lengths of respective parasitic elements in the multibeam antenna are switched by an impedance converter to allow the parasitic elements to function as a wave director and reflector.
Figure 19B:
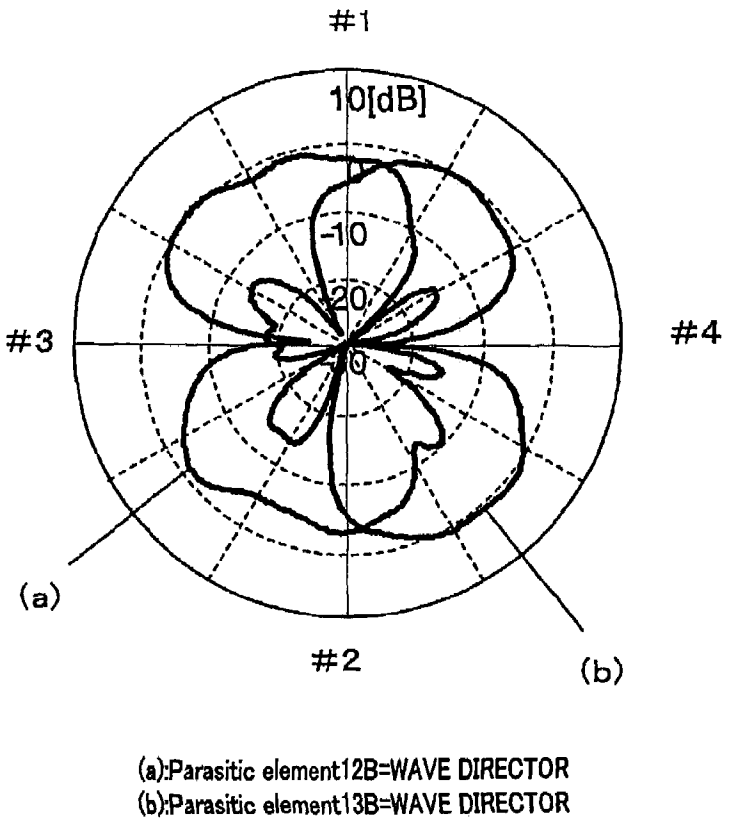

FIG. 18 is a view showing input characteristics in the case where the electrical lengths of respective parasitic elements 12A, 13A, 12B and 13B are switched by the impedance converter (MMIC switch) 22 to allow the parasitic elements to function as a wave director and reflector in the multibeam antenna 110 shown in FIG. 15. FIGS. 19A and 19B are directivity characteristics in the above case.

In a Yagi-Uda cross slot antenna in which the MMIC switches are mounted on the parasitic slots, the MMIC switches are switched to allow the parasitic slots to function as a wave director and reflector, and thereby to change the directivity. For example, when the directivity is to be set for direction #1 (+Y direction), the MMIC switches are set so as to allow the parasitic element 12A to become a wave director and the parasitic elements 12B, 13A, and 13B to become reflectors.

It can be seen, from the input characteristics shown in FIG. 18, that the frequency band of the Yagi-Uda cross slot antenna is about 200 MHz (5.1 to 5.3 GHz), which is substantially the same as that of the antenna in which the MMIC switch is not mounted on the parasitic slots.

Further, as can be seen from the directivity characteristics of the Yagi-Uda cross slot antenna shown in FIGS. 19A and 19B, the directivity is directed to the wave director side in any direction to allow this antenna apparatus to function as the Yagi-Uda antenna. In FIG. 19A, (a) is directivity characteristics obtained in the case where the parasitic element 12A is allowed to function as a wave director and the parasitic elements 12B, 13A, and 13B are allowed to function as reflectors, and (b) is directivity characteristics obtained in the case where the parasitic element 13A is allowed to function as a wave director and the parasitic elements 12A, 12B, and 13B are allowed to function as reflectors. In FIG. 19B, (a) is directivity characteristics obtained in the case where the parasitic element 12B is allowed to function as a wave director and the parasitic elements 12A, 13A, and 13B are allowed to function as reflectors, and (b) is directivity characteristics obtained in the case where the parasitic element 13B is allowed to function as a wave director and the parasitic elements 12A, 12B, and 13A are allowed to function as reflectors.

The antenna gain of the Yagi-Uda cross slot antenna is shown in Table 2. Although the gains are slightly decreased due to the mounting of the MMIC switch, the average gains in the desired direction are greater than the other directions by about 6 dB or more. From this, it can be confirmed that the beam switch antenna operates satisfactorily. As a result, the beam switch antenna capable of switching the directivity in four directions can be obtained.

TABLE 2

| | Maximum gain | Average gain | Desired direction | Other directions |
|---|---|---|---|---|
| Direction #1 | 0.69 | −4.81 | −1.89 | −10.6 |
| Direction #2 | −0.03 | −4.64 | −2.2 | −7.9 |
| Direction #3 | 0.92 | −3.83 | −1.17 | −7.1 |
| Direction #4 | 2.04 | −3.68 | −0.27 | −12.4 |

Figure 20A:
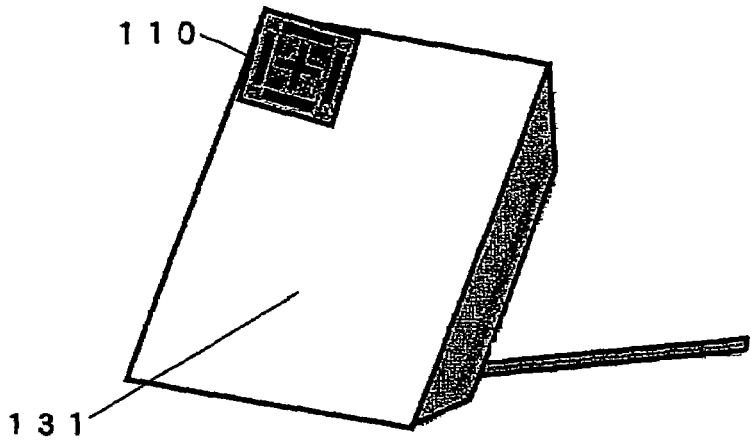
FIGS. 20A to 20C are views each schematically showing a mounted state of the multibeam antenna according to the present invention.
Figure 20B:
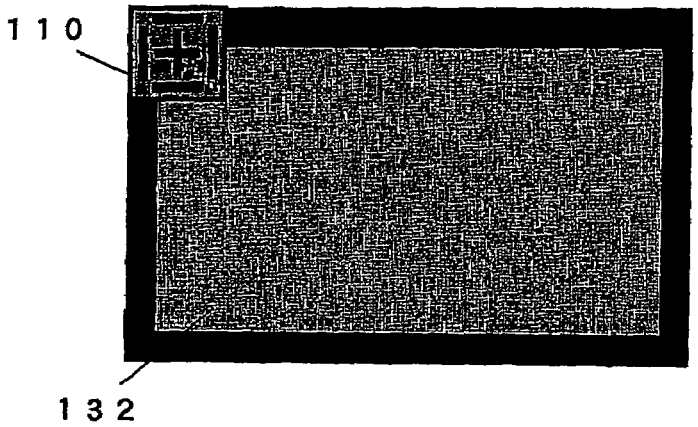
Figure 20C:
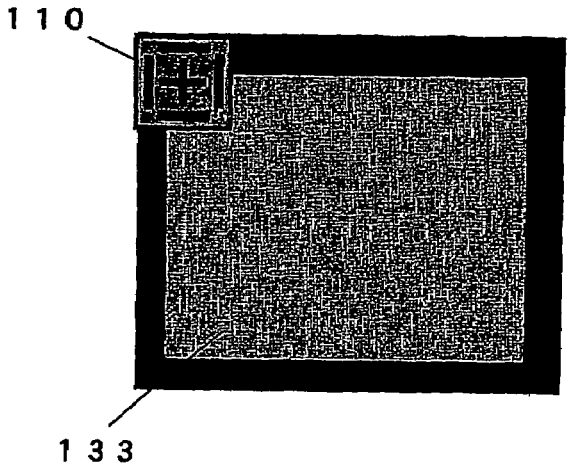

When the multibeam antenna 110 having the configuration as described above is mounted on a wireless LAN base station 131 (FIG. 20A), a note-type PC (information terminal) 132 (FIG. 20B), a wireless TV (AV equipment) 133 (FIG. 20C), it is possible to suppress interference wave which is generated at a building wall or the like due to reflection of radio waves without increasing a transmitting and receiving system.

Figure 21:
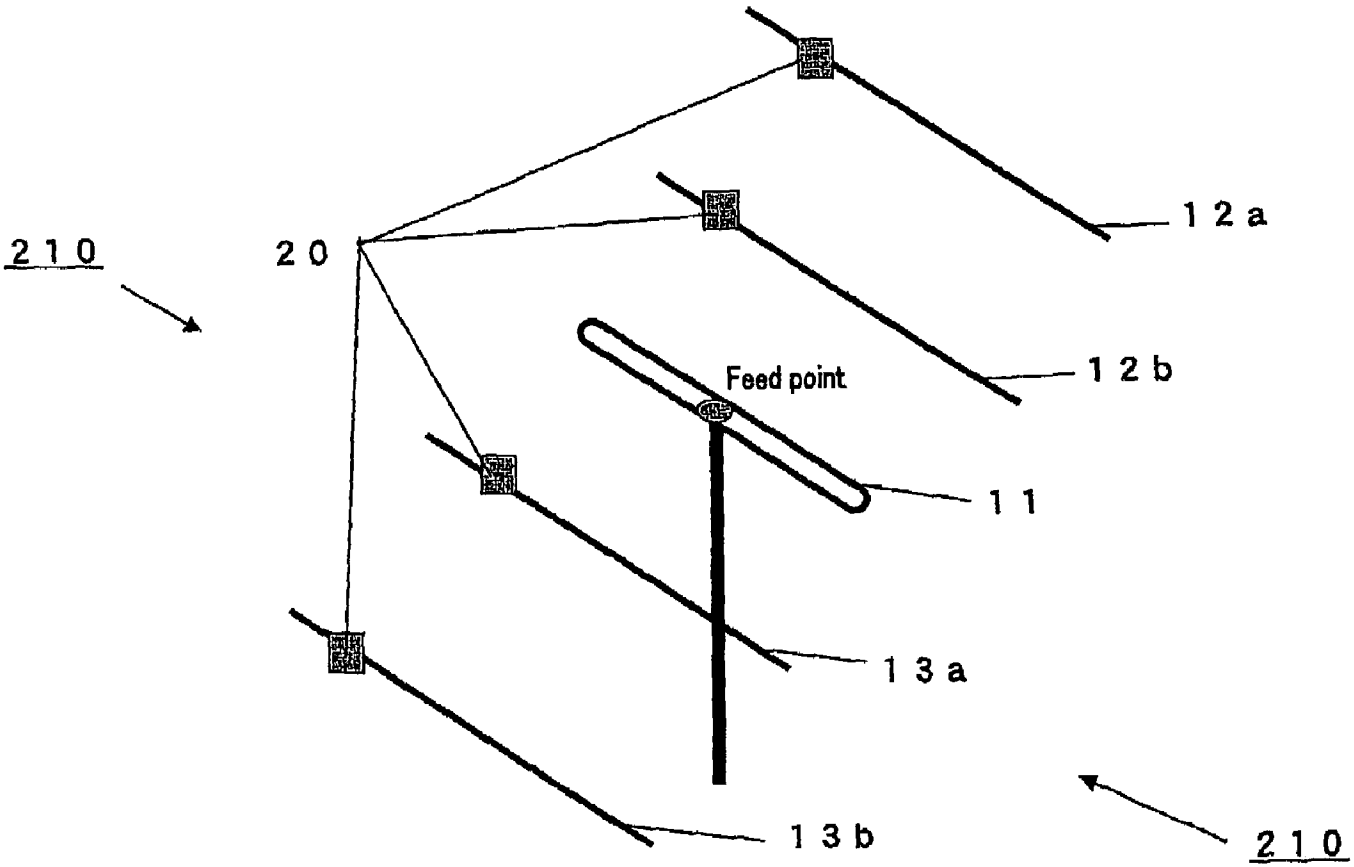
FIG. 21 is a perspective view schematically showing another configuration of the multibeam antenna according to the present invention.

The application of the present invention is not limited to the slot type antenna. For example, also in a multibeam antenna 210 shown in FIG. 21 which uses a linear antenna as the radiation element 11, a combination of the parasitic elements 12*a*, 12*b*, 13*a*, 13*b* and switching elements 20 allows the same effect to be achieved.

It should be understood by those skilled in the art that various modifications, combinations, sub-combinations and alternations may occur depending on design requirements and other factors insofar as they are within the scope of the appended claims or the equivalents thereof.

What is claimed is:

1. A multibeam antenna comprising:

an antenna element array including one or more feed elements and N (N: natural number) parasitic elements, wherein the electrical length of one or more parasitic elements are made variable, and wherein the feed element and N parasitic elements are slot antenna elements.

2. A multibeam antenna comprising:

a first antenna elements array including a first feed element and first parasitic elements; and a first switching element adapted to vary an electrical length for one of said first parasitic elements, wherein said one of said first parasitic elements is a first parasitic slot within a conductor.

3. The multibeam antenna according to claim 2, wherein said first switching element divides a slot length of said first parasitic slot.

4. The multibeam antenna according to claim 2, wherein said first antenna element array includes another of said first parasitic elements, said another of said first parasitic elements being a second parasitic slot within said conductor, said first switching element shortening a slot length of said first parasitic slot to a length shorter than said second parasitic slot.

5. The multibeam antenna according to claim 4, wherein said first feed element is a radiation slot within said conductor, said radiation slot being between said first parasitic slot and said second parasitic slot.

6. The multibeam antenna according to claim 5, further comprising:

a second antenna element array including a second feed element and second parasitic elements; and a second switching element adapted to vary an electrical length for one of said second parasitic elements.

7. The multibeam antenna according to claim 6, wherein said second antenna element is perpendicular to said first antenna element.

8. The multibeam antenna according to claim 6, wherein said second switching element divides a slot length for said one of said second parasitic elements.

9. The multibeam antenna according to claim 6, wherein said second feed element is another radiation slot within said conductor, said first radiation slot crossing said another radiation slot.

* * * * *